US010362663B1

(12) United States Patent
Kostrun

(10) Patent No.: US 10,362,663 B1
(45) Date of Patent: Jul. 23, 2019

(54) OVERDRIVE DIMMING

(71) Applicant: Marijan Kostrun, Rowley, MA (US)

(72) Inventor: Marijan Kostrun, Rowley, MA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 15/890,583

(22) Filed: Feb. 7, 2018

(51) Int. Cl.
*H05B 33/08* (2006.01)
*H05B 37/03* (2006.01)

(52) U.S. Cl.
CPC ..... *H05B 37/038* (2013.01); *H05B 33/0824* (2013.01); *H05B 33/0893* (2013.01)

(58) Field of Classification Search
None
See application file for complete search history.

(56) References Cited

U.S. PATENT DOCUMENTS

2011/0084701 A1* 4/2011 Bancken ..... H05B 33/0818 324/414
2012/0290241 A1* 11/2012 Nguyen ..... G01R 31/2635 702/65
2017/0111963 A1* 4/2017 Kovatchev ..... B60Q 1/1415
2017/0325301 A1* 11/2017 Maa ..... H05B 33/0893
2018/0288841 A1* 10/2018 Gharagozloo ..... F26B 3/00

* cited by examiner

*Primary Examiner* — Seokjin Kim
(74) *Attorney, Agent, or Firm* — Yutian Ling

(57) ABSTRACT

A luminaire includes a microcontroller and program logic that calculates the operational age of a light engine that includes a plurality of light emitting diodes connected in series. The program logic uses changes in transition voltage to calculate the operational age of a light engine. Changes in forward voltage across the light engine are used to detect sudden catastrophic failure of individual light emitting diodes. In response to the sudden catastrophic failure of one of the light emitting diodes, the program logic adjusts the power provided to the light engine based on the calculated operational age of the light engine. For example, the operational age of the light engine may be compared with a warrantied lifespan, and the power may be adjusted to increase the likelihood of compliance with the warranty.

13 Claims, 6 Drawing Sheets

OVERDRIVE DIMMING

TECHNICAL FIELD

The subject matter of this disclosure is generally related to solid-state luminaires, and more particularly to management of luminance in response to catastrophic failure of individual LEDs (light emitting diodes).

BACKGROUND

Solid state luminaires have a variety of advantages over incandescent luminaires, including lower energy consumption, longer operational lifespan, improved durability, smaller size, and faster switching. A solid-state luminaire includes at least one array of LEDs. The luminance of the LED array is a function of the supply current, which is limited to a maximum current rating to avoid damaging the LEDs. Although LEDs have longer operational lifespans than incandescent bulbs, LED luminance gradually degrades over time. Moreover, individual LEDs of the array may suffer sudden catastrophic failure. Consequently, LED array luminance may change both gradually and suddenly.

SUMMARY

All examples, aspects and features mentioned in this document can be combined in any technically possible way.

Various implementations described herein include an apparatus including a light engine including a plurality of light emitting diodes connected in series, a power supply that generates an output power that is supplied to the light engine, and a processor that controls the power supply, the processor configured to calculate an operational age of the light engine, detect a sudden catastrophic failure of one of the light emitting diodes, and cause the power supply to adjust the output power based on the calculated operational age of the light engine in response to detecting the sudden catastrophic failure of one of the light emitting diodes.

In some embodiments, the operational age of the light engine is based on a forward voltage across the light engine and a forward current through the light engine. In some embodiments, the processor is configured to calculate the operational age of the light engine by causing the power supply to vary the forward voltage across the light engine while sampling the forward voltage and the forward current, and calculating a transition voltage from the sampled forward voltage and forward current. In some embodiments, the transition voltage is one of a plurality of transition voltages calculated from forward voltages and forward currents sampled at different times, and the processor is further configured to calculate the operational age of the light engine based on differences between at least two of the plurality of transition voltages. In some embodiments, the processor is further configured to determine whether the calculated operational age of the light engine exceeds a warrantied operational lifespan. In some embodiments, the processor is further configured to cause the power supply to adjust the output power to maintain a warrantied light engine luminance in response to determining that the calculated operational age of the light engine does not exceed the warrantied operational lifespan. In some embodiments, adjustment of the output power includes a decrease in output power. In some embodiments, the processor is further configured to cause the power supply to adjust the output power to maintain a luminance that is greater than a warrantied light engine luminance in response to determining that the calculated operational age of the light engine exceeds the warrantied operational lifespan. In some embodiments, adjustment of the output power includes an increase in output power.

Various implementations described herein include an apparatus including a light engine including a plurality of light emitting diodes connected in series, a switched-mode power supply that generates an output power that is supplied to the light engine, the switched-mode power supply setting the output power in response to a voltage control signal, and a microcontroller including a processor, a memory, an analog-to-digital converter, a digital-to-analog converter, and program logic that is stored in the memory and implemented by the processor, in which the analog-to-digital converter provides forward voltage across the light engine and forward current through the light engine to the processor, and the program logic uses the forward voltage and forward current to calculate an operational age of the light engine, detect sudden catastrophic failure of one of the light emitting diodes, and generate the voltage control signal to cause the power supply to adjust the output power in response to detection of the sudden catastrophic failure of one of the light emitting diodes based on the calculated operational age of the light engine, the voltage control signal being provided to the power supply by the processor via the digital-to-analog converter.

In some embodiments, the program logic determines that the calculated operational age of the light engine is greater than a warrantied operational lifespan and, in response, causes the power supply to adjust the output power to maintain a luminance that is greater than a warrantied light engine luminance.

Various implementations described herein include a method including calculating an operational age of a light engine that includes a plurality of light emitting diodes connected in series, detecting sudden catastrophic failure of one of the light emitting diodes, and adjusting power provided to the light engine based on the calculated operational age of the light engine in response to detecting the sudden catastrophic failure of one of the light emitting diodes.

In some embodiments, the calculated operational age of the light engine is based on a forward voltage across the light engine and a forward current through the light engine. In some embodiments, calculating the operational age of the light engine includes varying the forward voltage across the light engine while sampling the forward voltage and the forward current, and calculating a transition voltage from the sampled forward voltage and forward current. In some embodiments, the method further includes calculating the operational age of the light engine based on differences in transition voltages calculated from forward voltages and forward currents sampled at different times. In some embodiments, the method further includes determining whether the calculated operational age of the light engine exceeds a warrantied operational lifespan. In some embodiments, the method further includes adjusting the power provided to the light engine to maintain a warrantied light engine luminance in response to determining that the calculated operational age of the light engine does not exceed the warrantied operational lifespan. In some embodiments, adjusting the power provided to the light engine includes decreasing the power to the light engine. In some embodiments, the method further includes adjusting the power provided to the light engine to maintain a luminance that is greater than the warrantied light engine luminance in response to determining that the calculated operational age of the light engine exceeds the warrantied operational lifespan. In some embodiments, adjusting the power provided to the light engine includes increasing the power to the light engine.

These and other features will be understood better by reading the following detailed description, taken together with the figures herein described. The accompanying figures are not intended to be drawn to scale. Each identical or nearly identical component that is illustrated in various figures may be represented by a like numeral. For purposes of clarity, not every component may be labeled in every figure.

DETAILED DESCRIPTION

Some aspects, features and embodiments described herein may include machines such as computers, electronic components, optical components, and computer-implemented processes. It will be apparent to those of ordinary skill in the art that the computer-implemented processes may be stored as computer-executable instructions on a non-transitory computer-readable medium. Furthermore, it will be understood by those of ordinary skill in the art that the computer-executable instructions may be executed on a variety of tangible processor devices. For ease of exposition, not every device or component that may be part of a computer or data storage system is described herein. Those of ordinary skill in the art will recognize such devices and components in view of the teachings of the present disclosure and the knowledge generally available to those of ordinary skill in the art. The corresponding machines and processes are therefore enabled and within the scope of the disclosure.

Figure 1:
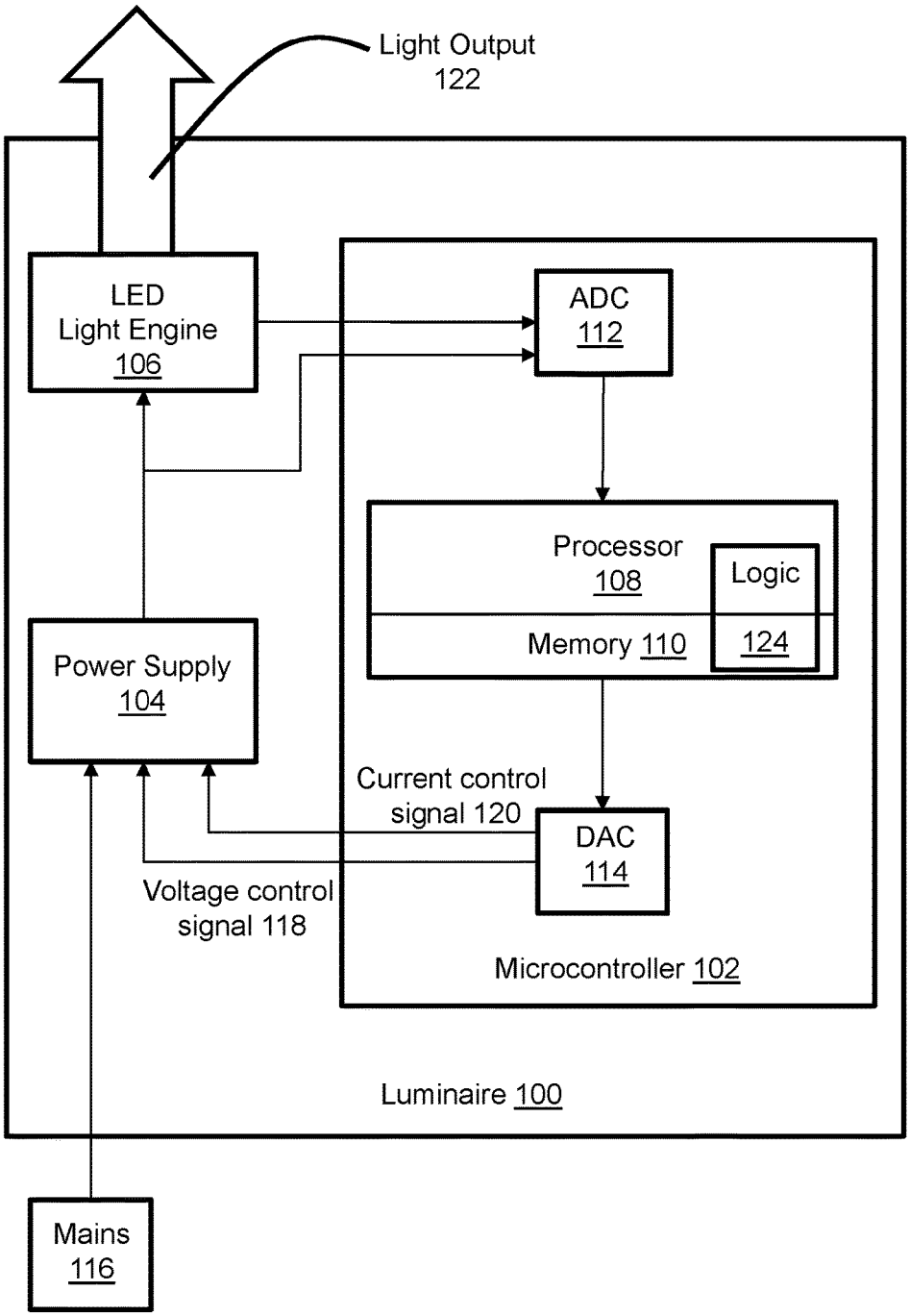
FIG. 1 is a block diagram of a luminaire with overdrive dimming in accordance with various embodiments.

FIG. 1 is a block diagram of a luminaire 100 with overdrive dimming in accordance with various embodiments. The luminaire 100 includes a microcontroller 102, a power supply 104, and an LED light engine 106. The microcontroller 102 includes a processor 108, memory 110, ADC (analog to digital converter) 112, and DAC (digital to analog converter) 114. The power supply 104 may be a switched-mode power supply that converts the voltage and current characteristics of a DC (direct current) or AC (alternating current) source, e.g. mains 116. The power supply 104 provides electrical power to the light engine 106 by continually switching between low-dissipation, full-ON and full-OFF states. Voltage regulation is achieved by varying the ratio of ON-to-OFF time in response to a voltage control signal 118 from the microcontroller 102 via DAC 114. Current regulation is achieved by setting a current level in response to a current control signal 120 from the microcontroller 102 via DAC 114.

Figure 2:
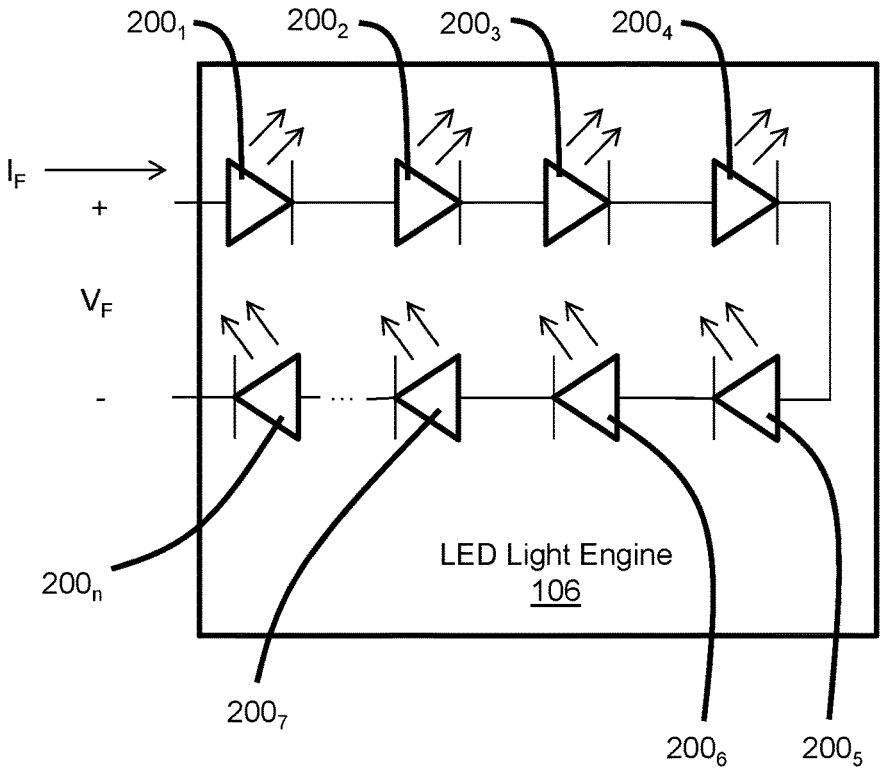
FIG. 2 illustrates a simplified embodiment of the light engine of FIG. 1 in accordance with various embodiments.

Referring to FIGS. 1 and 2, the LED light engine 106 includes an array of LEDs $\mathbf{200}_1$ through $\mathbf{200}_n$ connected in series. Each LED $\mathbf{200}_1$ through $\mathbf{200}_n$ generates light that contributes to the light output 122 of the LED light engine 106. The amount of luminous power generated by each LED $\mathbf{200}_1$ through $\mathbf{200}_n$ is a function of the characteristics of the power provided to the LED light engine 106 by power supply 104. Consequently, the luminous power of the light output 122 of the LED light engine 106 is a function of the number N of LEDs $\mathbf{200}_1$ through $\mathbf{200}_n$ that are in service and generating light, the forward voltage $V_F$ across the LED light engine 106, and the forward current $I_F$ through the LED light engine 106. However, as LEDs gradually degrade during their service lifetime, generated luminous power decreases for a given forward voltage and forward current due to decreasing LED efficiency. Further, LEDs that suffer sudden catastrophic failure cease to generate light and exhibit a change in electrical resistance.

Figure 3:
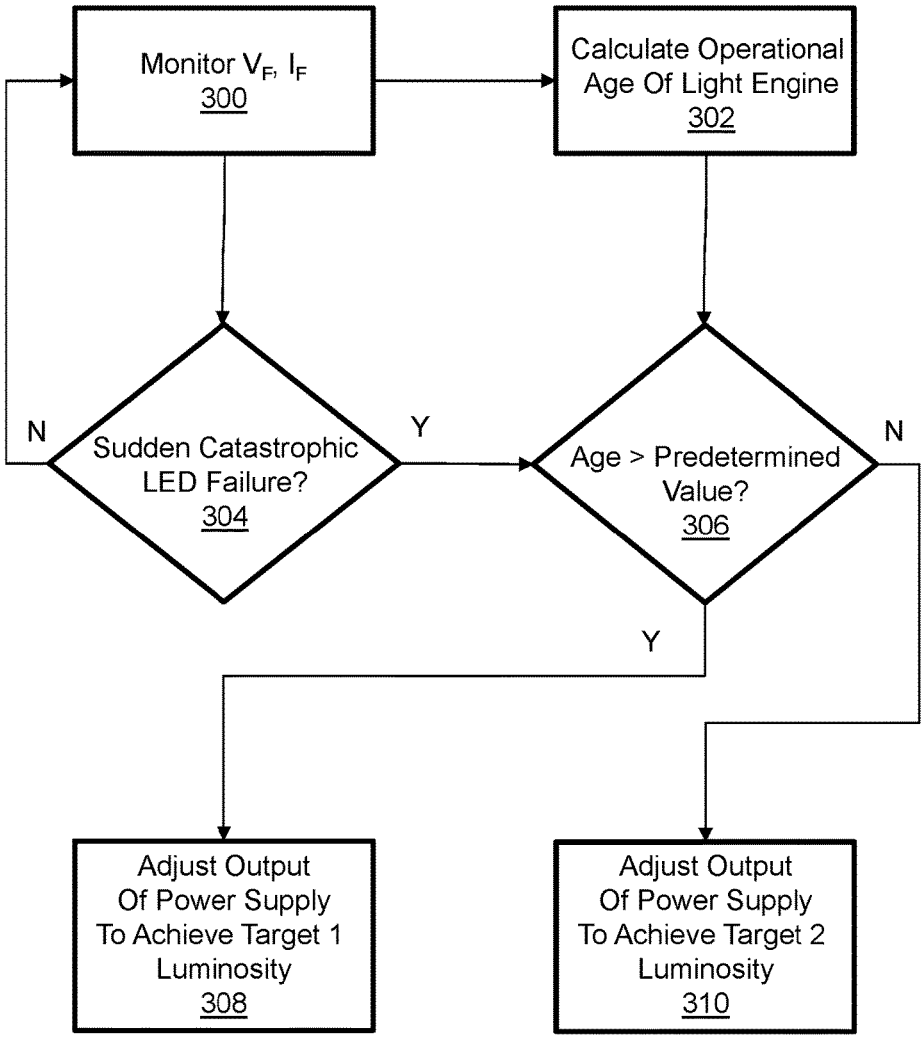
FIG. 3 illustrates a method of overdrive dimming for the luminaire of FIG. 1 in accordance with various embodiments.

Referring to FIGS. 1 and 3, logic 124 stored in memory 110 and implemented by processor 108 manages the light output 122 of the LED light engine 106. As indicated in block 300, the forward voltage $V_F$ across the LED light engine 106 and the forward current $I_F$ through the LED light engine 106 are monitored. For example, $V_F$ and $I_F$ may be sampled by ADC 112 and provided to processor 108. Sampled values of $V_F$ and $I_F$ may be stored in memory 110. Logic 124 calculates the operational age of the LED light engine 106 (and thus of LEDs $\mathbf{200}_1$ through $\mathbf{200}_n$) based on the sampled values of $V_F$ and $I_F$ as indicated in block 302. When a sudden catastrophic LED failure is detected as indicated in decision block 304, the most recent calculated operational age of the light engine is compared with a predetermined value as indicated in decision block 306. As indicated in block 308, if the most recent calculated operational age of the LED light engine 106 is greater (older) than the predetermined value then the logic 124 calculates voltage control signal 118 and current control signal 120 values to adjust the output of the power supply 104 to achieve a target 1 luminosity of light output 122. As indicated in block 310, if the most recent calculated operational age of the LED light engine 106 is less than (younger) than the predetermined value then the logic 124 calculates voltage control signal 118 and current control signal 120 values to adjust the output of the power supply 104 to achieve a target 2 luminosity of light output 122. The values may be calculated based on the known number of operational LEDs and the known luminance of each of the operational LEDs. Moreover, degradation of luminance due to age may be calculated and used to determine the values to achieve the targets.

A wide variety of values of the target 1 luminosity and target 2 luminosity may be selected. In accordance with various embodiments the predetermined value with which the current calculated operational age is compared in decision block 306 corresponds to a warranty for the luminaire 100. For example, the luminaire 100 may be warrantied to generate light output 122 at or above a predetermined luminosity for a predetermined number of hours or days of service. At the start of its service lifetime the luminaire 100 may be configured to generate light output 122 above the warrantied luminosity. If the most recent calculated operational age is greater than the predetermined number of hours or days of service for which the luminaire 100 is warrantied when the sudden catastrophic LED failure is detected then the logic 124 may calculate voltage control signal 118 and current control signal 120 values to maintain the light output 122 (i.e. compensate for the sudden catastrophic LED failure), to achieve a maximum safe output, or to achieve some other value. For example, light output 122 may be maintained at or reset to a luminosity that is greater than the warrantied value. Although the associated voltage control signal 118 and current control signal 120 values may increase the likelihood of further sudden catastrophic LED failures, such failures will not cause a failure to satisfy the warranty conditions because the luminaire is aged beyond the warranty. If the most recent calculated operational age is less than the predetermined number of hours or days of service for which the luminaire 100 is warrantied then the logic 124 may calculate voltage control signal 118 and current control signal 120 values to maintain the warrantied light output 122 while reducing the likelihood of further sudden catastrophic LED failures. For example, light output 122 may be reduced from some level above the warrantied luminosity to the warrantied luminosity, or anywhere therebetween. As a result, likelihood of satisfying the warranty conditions may be increased.

Figure 4:
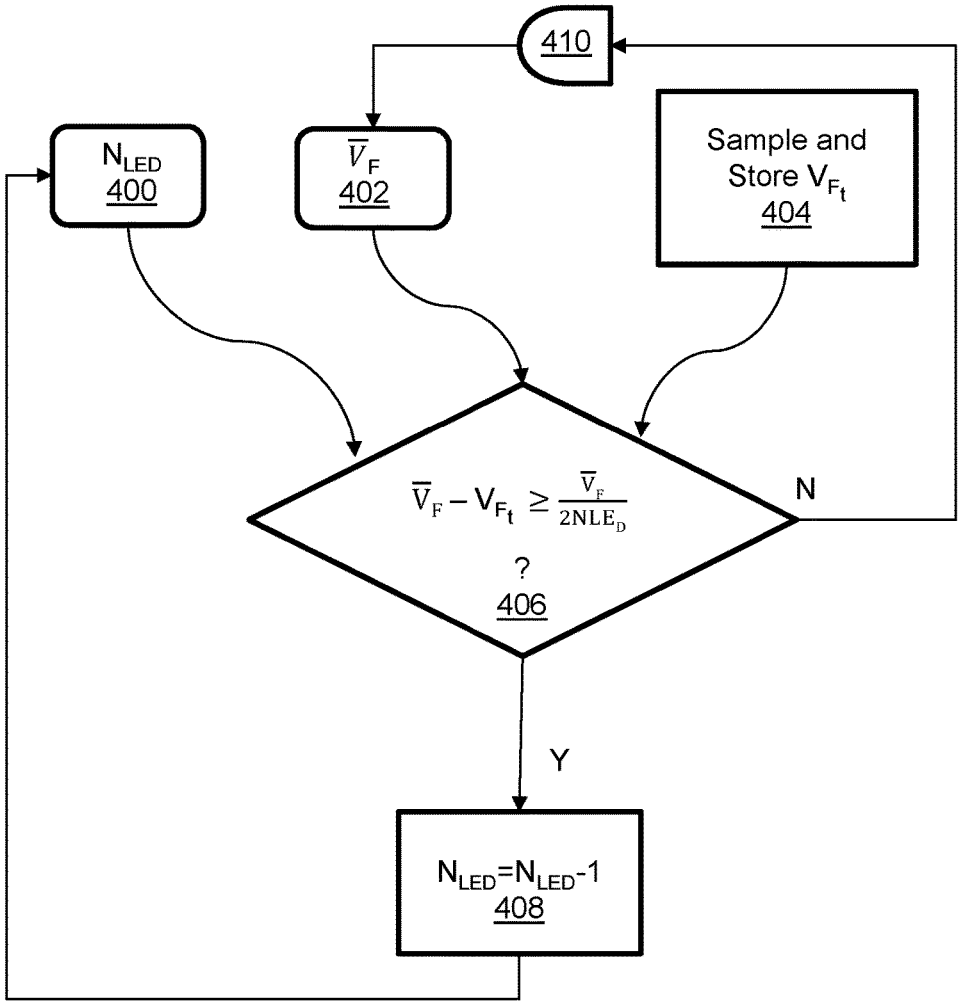
FIG. 4 illustrates the LED failure detection of FIG. 3 in accordance with various embodiments.

FIG. 4 illustrates the LED failure detection of FIG. 3 in accordance with various embodiments. Inputs 400, 402, and 404 include respectively the number of LEDs currently in service $N_{LED}$, a moving average of the forward voltage $\overline{V}_F$, and the most recently sampled and stored forward voltage $V_F$ from a time t. A sudden catastrophic LED failure is declared as indicated in decision block 406 if:

$$\overline{V}_F - V_{F_t} \geq \frac{\overline{V}_F}{2N_{LED}}$$

In response to declaration of sudden catastrophic LED failure in decision block 406 the number of LEDs currently in service $N_{LED}$ is decremented as indicated in block 408. If the most recently sampled and stored forward voltage $V_{Ft}$ does not indicate sudden catastrophic LED failure then the forward voltage value is used to update the running average forward voltage $\overline{V}_F$ following a delay 410. For example and without limitation, the running average forward voltage $\overline{V}_F$ may be updated on a daily basis.

Figure 5:
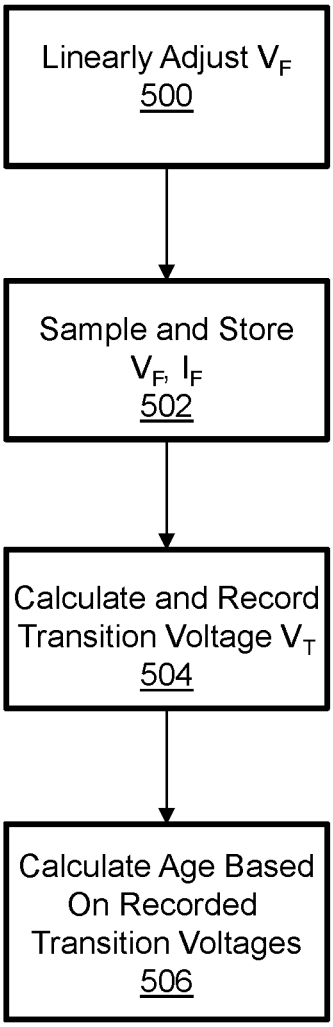
FIG. 5 illustrates the LED operational age calculation of FIG. 3 in accordance with various embodiments.

FIG. 5 illustrates the LED operational age calculation of FIG. 3 in accordance with various embodiments. LED operational age calculation may occur periodically or in response to some trigger. The forward voltage $V_F$ is linearly adjusted as indicated in block 500. As the forward voltage $V_F$ is linearly adjusted, values of the forward voltage $V_F$ and forward current $I_F$ are sampled and stored as indicated in block 502. Transition voltage values are calculated and stored as indicated in block 504. The operational age of the LED array is calculated from the recorded transition voltages as indicated in block 506.

Figure 6:
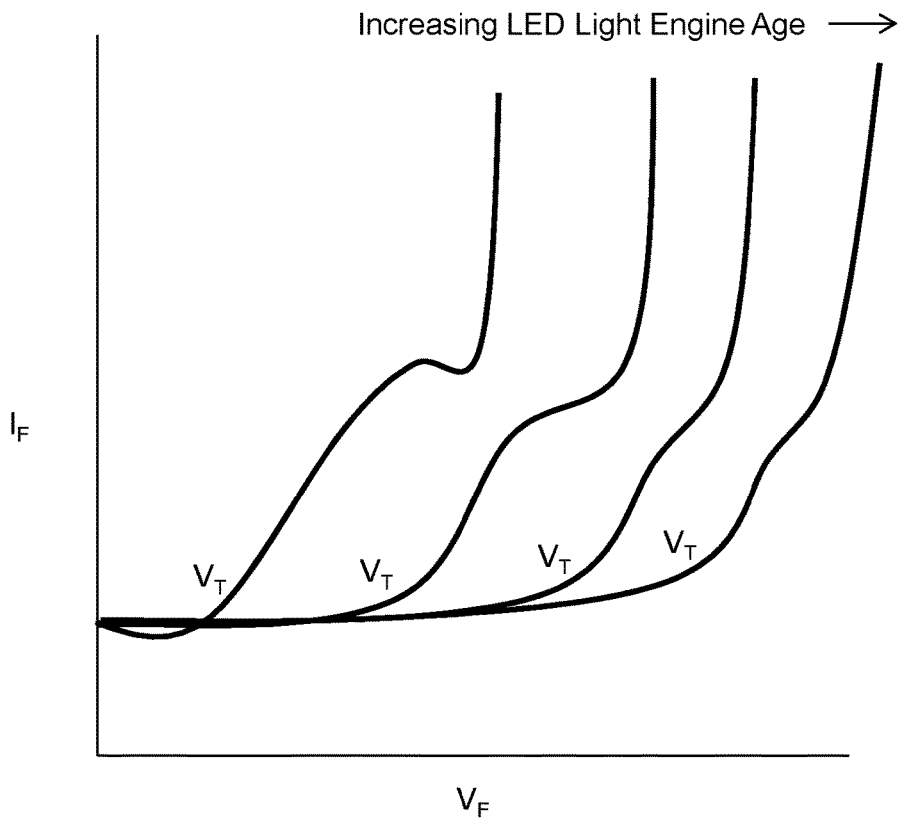
FIG. 6 illustrates change in transition voltage as a function of LED light engine aging in accordance with various embodiments.

FIG. 6 illustrates change in transition voltage as a function of LED light engine aging in accordance with various embodiments. The forward voltage $V_F$ is ramped at a constant rate, $dV_F/dt$, while the forward voltage $V_F$ and forward current $I_F$ are sampled and recorded. The measured forward current has a conductive component and a capacitive component. The capacitive component is proportional to $dV_F/dt$ and the differential capacitance. At sufficiently high scan rates and low forward voltage the forward current is dominated by the capacitive component. The transition voltage VT is defined by an inflection point on the $I_F$-$V_F$ curve as the forward voltage $V_F$ is ramped. The transition voltage $V_T$ increases, i.e. shifts to the right, as the LED light engine ages. The change in transition voltage over time is a function of accumulation of trapped positive charge. The difference between the initial transition voltage when the LED light engine is placed into service and the present transition voltage at any given time thus provides an indication of accumulated positive charge and thus the operational age of the LED light engine.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

A number of features, aspects, embodiments and implementations have been described. Nevertheless, it will be understood that a wide variety of modifications and combinations may be made without departing from the scope of the inventive concepts described herein. Accordingly, those modifications and combinations are within the scope of the following claims.

What is claimed is:

1. An apparatus comprising:

a light engine comprising a plurality of light emitting diodes connected in series;

a power supply that generates an output power that is supplied to the light engine; and a processor that controls the power supply, the processor configured to:

calculate an operational age of the light engine;

detect a sudden catastrophic failure of one of the light emitting diodes;

determine whether the calculated operational age of the light engine exceeds a warrantied operational lifespan; and cause the power supply to adjust the output power in response to detecting the sudden catastrophic failure of one of the light emitting diodes, wherein:

the output power is adjusted to maintain a warrantied light engine luminance in response to determining that the calculated operational age of the light engine does not exceed the warrantied operational lifespan; and the output power is adjusted to maintain a luminance that is greater than the warrantied light engine luminance in response to determining that the calculated operational age of the light engine exceeds the warrantied operational lifespan.

2. The apparatus of claim 1, wherein the operational age of the light engine is based on a forward voltage across the light engine and a forward current through the light engine.

3. The apparatus of claim 2, wherein the processor is configured to calculate the operational age of the light engine by:

causing the power supply to vary the forward voltage across the light engine while sampling the forward voltage and the forward current; and calculating a transition voltage from the sampled forward voltage and forward current.

4. The apparatus of claim 3 wherein:

the transition voltage is one of a plurality of transition voltages calculated from forward voltages and forward currents sampled at different times; and the processor is further configured to calculate the operational age of the light engine based on differences between at least two of the plurality of transition voltages.

5. The apparatus of claim 1, wherein maintaining the warrantied light engine luminance comprises a decrease in output power.

6. The apparatus of claim 1, wherein maintaining a luminance that is greater than the warrantied light engine luminance comprises an increase in output power.

7. An apparatus comprising:

a light engine comprising a plurality of light emitting diodes connected in series;

a switched-mode power supply that generates an output power that is supplied to the light engine, the switched-mode power supply setting the output power in response to a voltage control signal; and a microcontroller comprising a processor, a memory, an analog-to-digital converter, a digital-to-analog converter, and program logic that is stored in the memory and implemented by the processor;

wherein the analog-to-digital converter provides forward voltage across the light engine and forward current through the light engine to the processor, and the program logic uses the forward voltage and forward current to calculate an operational age of the light engine, detect sudden catastrophic failure of one of the light emitting diodes, determine whether the calculated operational age of the light engine is greater than a warrantied operational lifespan, and generate the voltage control signal to cause the power supply to adjust the output power in response to detection of the sudden catastrophic failure of one of the light emitting diodes, wherein adjusting the voltage control signal comprises maintaining a luminance that is greater than a warrantied light engine luminance when the calculated operational age of the light engine is greater than the warrantied operational lifespan and maintaining a luminance equal to the warranted light engine luminance when the calculated operational age of the light engine does not exceed the warrantied operational lifespan, the voltage control signal being provided to the power supply by the processor via the digital-to-analog converter.

8. A method comprising:

calculating an operational age of a light engine that comprises a plurality of light emitting diodes connected in series;

detecting sudden catastrophic failure of one of the light emitting diodes;

determining whether the calculated operational age of the light engine exceeds a warrantied operational lifespan; and adjusting power provided to the light engine in response to detecting the sudden catastrophic failure of one of the light emitting diodes, wherein:

the power is adjusted to maintain a warrantied light engine luminance in response to determining that the calculated operational age of the light engine does not exceed the warrantied operational lifespan; and the power is adjusted to maintain a luminance that is greater than the warrantied light engine luminance in response to determining that the calculated operational age of the light engine exceeds the warrantied operational lifespan.

9. The method of claim 8, wherein the calculated operational age of the light engine is based on a forward voltage across the light engine and a forward current through the light engine.

10. The method of claim 9, wherein calculating the operational age of the light engine comprises:

varying the forward voltage across the light engine while sampling the forward voltage and the forward current; and calculating a transition voltage from the sampled forward voltage and forward current.

11. The method of claim 10, further comprising:

calculating the operational age of the light engine based on differences in transition voltages calculated from forward voltages and forward currents sampled at different times.

12. The method of claim 8, wherein adjusting the power to maintain a warrantied light engine luminance comprises decreasing the power to the light engine.

13. The method of claim 8, wherein adjusting the power to maintain a luminance that is greater than the warrantied light engine luminance comprises increasing the power to the light engine.

* * * * *